United States Patent [19]

Mollet et al.

[11] 4,310,617

[45] Jan. 12, 1982

[54] PROCESS FOR THE PRODUCTION OF MASKED POSITIVE COLOR IMAGES BY THE SILVER DYE BLEACH PROCESS

[75] Inventors: Herbert Mollet, Tentlingen; Alfred Oetiker, Fribourg; Carlo Boragine, Villars-sur-Glâne, all of Switzerland

[73] Assignee: Ciba-Geigy AG, Basel, Switzerland

[21] Appl. No.: 174,478

[22] Filed: Aug. 1, 1980

[30] Foreign Application Priority Data

Aug. 1, 1979 [CH] Switzerland ..... 7078/79

[51] Int. Cl.[3] ..... G03C 7/04

[52] U.S. Cl. ..... 430/359; 430/390; 430/391; 430/504; 430/505; 430/957

[58] Field of Search ..... 430/504, 505, 359, 390, 430/391, 957

[56] References Cited

U.S. PATENT DOCUMENTS

| | | | |
|---|---|---|---|
| 2,336,380 | 12/1943 | Wilmanns | 430/360 |
| 2,673,800 | 3/1954 | Meeussen et al. | 430/214 |
| 3,708,300 | 1/1973 | Luckey | 430/504 |
| 4,046,566 | 9/1977 | Marthaler | 430/359 |
| 4,082,553 | 4/1978 | Groet | 430/504 |

*Primary Examiner*—J. Travis Brown

[57] ABSTRACT

Production of masked positive color images by the silver dye bleach process, by exposing a photographic material for the silver dye bleach process, silver developing, dye-bleaching, silver-bleaching and fixing, optionally, the step of silver-bleaching is carried out in a combined treatment bath together with dye-bleaching and/or fixing. A photographic material is used which contains (a) in at least one layer, at least one first bleachable image dye, which has at least one undesired color density which is to be compensated, (b) in the layer or layers (a) and/or in a layer adjacent to the said layer or layers (a), an iodide-containing silver halide emulsion allocated to the said dye or to each of the said dyes, (c) in at least one further layer, at least, in each case, a second dye, the main color density of which corresponds to the secondary color density of the first dye or dyes which is to be compensated, (d) in the layer or layers (c) and/or in a layer or layers adjacent to the said layer or layers (c), a silver halide emulsion which is free from iodide or has a low iodide content compared with the emulsion mentioned under (b) and is allocated to the said dye or dyes, and (e) in at least one layer (c) and/or in at least one further layer which is adjacent to the layer or layers (c) and which is separated from one or more layers (a) by at least one interlayer, a fogged silver halide emulsion which is free from iodide or has a low iodide content, is spontaneously developable to maximum density without exposure and contains a development retarder.

Developing is carried out in a developer solution which does not contain any silver complexing agents.

The resulting color images display outstanding color reproduction.

19 Claims, 2 Drawing Figures

Fig. 2 TABLE

LEGEND

Figure 1:
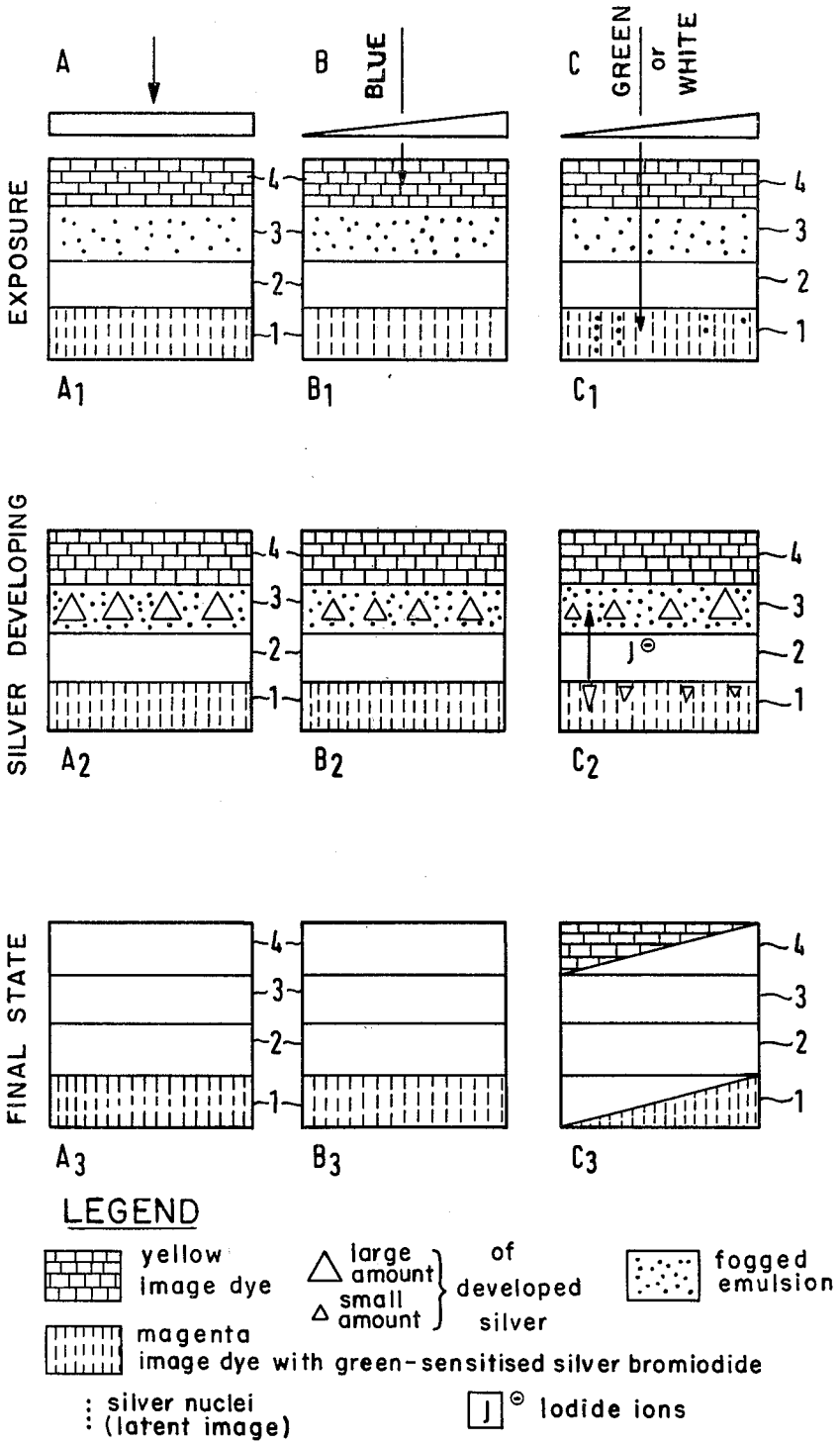

YE : yellow
MA : magenta
CY : cyan
MC : masked color (s)
$D_1, D_2, D_3$ : dye layers
C : cover layer SCD : secondary color density
R : red
G : green
B : blue
sensitising or absorption range F : fogged emulsion
S : septum $J^{\ominus}$ ; ▼ : layer containing AgJ (▽ without AgJ)

| | 1 | 2 | 3 | 4 | 5 | 6 |
|---|---|---|---|---|---|---|
| $D_1$ | YE | YE | MA | MA | CY | CY |
| $D_2$ | MA | CY | YE | CY | YE | MA |
| $D_3$ | CY | MA | CY | YE | MA | YE |
| MC | CY+MA | | YE+CY | | YE+MA | |
| SCD | B | | G | | R | |

| | 19 | 20 | 21 | 22 | 23 | 24 |
|---|---|---|---|---|---|---|
| $D_1$ | YE | YE | MA | MA | CY | CY |
| $D_2$ | MA | CY | YE | CY | YE | MA |
| $D_3$ | CY | MA | CY | YE | MA | YE |
| MC | YE | | MA | | CY | |
| SCD | G+R | | B+R | | B+G | |

| | 7 | 8 | 9 | 10 | 11 | 12 |
|---|---|---|---|---|---|---|
| $D_1$ | MA | CY | YE | CY | YE | MA |
| $D_2$ | YE | YE | MA | MA | CY | CY |
| $D_3$ | CY | MA | CY | YE | MA | YE |
| MC | CY+MA | | CY+YE | | YE+MA | |
| SCD | B | | G | | R | |

| | 25 | 26 | 27 | 28 | 29 | 30 |
|---|---|---|---|---|---|---|
| $D_1$ | MA | CY | YE | CY | YE | MA |
| $D_2$ | YE | YE | MA | MA | CY | CY |
| $D_3$ | CY | MA | CY | YE | MA | YE |
| MC | YE | | MA | | CY | |
| SCD | G+R | | B+R | | B+G | |

| | 13 | 14 | 15 | 16 | 17 | 18 |
|---|---|---|---|---|---|---|
| $D_1$ | MA | CY | YE | CY | YE | MA |
| $D_2$ | CY | MA | CY | YE | MA | YE |
| $D_3$ | YE | YE | MA | MA | CY | CY |
| MC | MA+CY | | YE+CY | | YE+MA | |
| SCD | B | | G | | R | |

| | 31 | 32 | 33 | 34 | 35 | 36 |
|---|---|---|---|---|---|---|
| $D_1$ | MA | CY | YE | CY | YE | MA |
| $D_2$ | CY | MA | CY | YE | MA | YE |
| $D_3$ | YE | YE | MA | MA | CY | CY |
| MC | YE | | MA | | CY | |
| SCD | G+R | | B+R | | B+G | |

PROCESS FOR THE PRODUCTION OF MASKED POSITIVE COLOR IMAGES BY THE SILVER DYE BLEACH PROCESS

Photographic processes for the production of coloured images or for reproducing coloured originals operate virtually exclusively by the subtractive principle. In general, three superimposed layers are used on a transparent or opaque base and these layers each contain a partial image in the subtractive primary colours cyan, magenta and yellow. It is thus possible to reproduce all of the colour shades within the colour space determined by the three primary colours. By suitable choice of the image dyes it is thus possible satisfactorily to reproduce the colours occurring in nature or in the original, in respect of tonality and saturation. The prerequisite for this is a favourable mutual balance within the dye triad and a high saturation of the individual primary colours.

Under practical conditions, however, a difficulty arises which cannot easily be overcome by simple photographic means: this is because the dyes which are available for the reproduction of the three primary colours cyan, magenta and yellow all have, in addition to the desired absorption in one of the three complementary main colours red, green or blue, at least one further absorption range, even though this is weaker, in a spectral region assigned to the other two primary colours. This so-called secondary colour density does not in itself prevent the reproduction of all of the colour values and brightness values occurring within the colour space; it has, however, the result that a change in the colour density within a colour layer, such as can be obtained by known photographic processes with the aid of a correspondingly sensitised silver halide emulsion, affects both the main colour density and also the secondary colour density. This results in undesired colour shifts and saturation losses, which very considerably interfere with the trueness of colour when an original is reproduced.

In principle, secondary colour densities are present in all three subtractive primary colours: in the case of yellow (main absorption in the blue) in the red and green, in the case of magenta (main absorption in the green) in the red and blue and in the case of cyan (main absorption in the red) in the green and blue. The secondary colour densities of the magenta dyes in the blue and the red and the secondary colour density of the cyan dye in the blue are particularly strong and therefore troublesome. The secondary colour density of the cyan dye in the green is somewhat less troublesome and the secondary colour densities of the yellow dye in the red and green are troublesome to an even lesser extent. The consequence of this is that in particular the reproduction of clear blue and red shades in photographic colour materials is always associated with difficulties.

There has been no lack of attempts to eliminate or at least to lessen this fundamental defect of the photographic colour materials in various ways. Since it has not been possible hitherto to find any cyan, magenta and yellow dyes without troublesome secondary colour densities, the aim had to be achieved indirectly: the basis of one of the processes known as masking is that, in additional layers with opposing gradation, the undesired secondary colour density of a dye is compensated in such a way that, independently of the particular main colour density, the sum of the secondary colour densities in the layer to be masked and the masking layer remains constant. When used consistently for all six secondary colour densities, however, the result of this process is that it is no longer possible to obtain pure white shades (=absence of any colour density), but at best neutral gray shades can be obtained. The process is therefore suitable in particular for the production of colour negatives or of colour separations in reproduction processes, that is to say processes in which the said disadvantage can be compensated again in the subsequent printing or reproduction stage.

The masking processes have found wide acceptance in the field of chromogenous colour photography (colour developing processes). Various effects are utilised for masking. Thus, for example, the residual silver halide remaining after developing can be used to form a mask image of opposing gradation, as is described in German Patent Specification Nos. 743,535 and 898,709 or in Swiss Patent Specification No. 271,389. Other patent specifications, such as, say, German Patent Specification No. 950,617 or British Patent Specification Nos. 665,657, 714,012 and 1,210,893, describe the production of a mask image by chemical conversion of the residual colour coupler which has not been consumed during colour developing.

A further method, which is described, for example, in German Patent Specification Nos. 1,643,980 and 2,185,220 or in Belgian Patent Specification No. 675,259, relates to the use of colour couplers which have a characteristic colour corresponding to the secondary colour density which is to be compensated in the dye developed therefrom (automasking). Other processes are based on the bleaching of azo dyes by the image silver formed during colour developing; such processes are described, for example, in French Patent Specification No. 1,414,803 or in German Democratic Republic Patent Specification No. 8,051. Coloured images, inverse to the original, can also be obtained in separate layers using direct-positive emulsions, as is described in French Patent Specification No. 904,964 or in German-Democratic Republic Patent Specification No. 8,051, or by the silver dye bleach process according to U.S. Pat. No. 2,336,380.

Further proposals relate, for example, to the bleaching of azo dyes by the oxidised colour developer (German Auslegeschrift No. 1,150,275), the controlled diffusion of a bleaching bath (U.S. Pat. No. 2,763,150) or the utilisation of silver complex diffusion (German Auslegeschrift No. 1,008,117). Finally, masking effects can also be obtained by false sensitising of individual emulsions, as is described in British Patent Specification No. 685,610.

Masked colour images, which are used for the production of colour prints or as colour separations for the production of printing plates for reproduction, can also be obtained by registering the compensating colour images on separate bases and superimposing the latter, together with the original, before the printing process. Processes of this type are described, for example, in German Patent Specification Nos. 975,867, 976,138, 976,904 and 965,615 and in German Auslegeschrift No. 1,142,757 and also in British Patent Specification No. 903,050.

Masking processes have also been disclosed for the production of subtractive positive images by the silver dye bleach process. Thus, for example, the combination of layers with negative emulsions with those which contain a direct-positive emulsion has been disclosed in U.S. Pat. Specification No. 2,387,754. In this case, partial images, inverse to the original, of the desired colour are formed on developing and dye-bleaching. U.S. Pat. No. 2,193,931 describes the combination of positive silver dye bleach images with negative mordant-fixed images produced from the image silver. Swiss Patent Specification No. 209,656 describes the production of mask images by the silver dye bleach process, emulsions with particularly shallow gradation being used for the mask layer. Finally, in British Patent Specification No. 523,179 a process has been disclosed in which, in one and the same layer, a positive image is produced by the silver dye bleach process and, at the same time, a negative image is produced in a different colour and, for example, the dye producing the positive image in the first image produces the negative image of the second colour on bleaching.

The processes described in these patent publications are suitable for the production of colour separations, for example for reproduction purposes. However, because of the residual colour density which remains even in the image areas, which should be white, these processes are not suitable for the direct production of positive images of a coloured original. Only partial masking, with which no further light absorption takes place in the image areas which have remained white, is permissible here. Surprisingly, the silver dye bleach process, in which all of the layers possess a colour gradation in the same sense with the original, is suitable for such partial masking if care is taken that, on exposure, a sensitivity shift in the layers takes place, in the individual partial ranges, in such a way that the desired masking effect is obtained.

It has been disclosed in U.S. Pat. No. 2,673,800 and in German Auslegeschrift No. 1,181,055 that negative coloured images can be obtained by the silver dye bleach process using silver complex diffusion at the same time. With these processes, the build-up of the corresponding silver image by physical developing is controlled image-wise by the diffusion of bromide ions from a silver bromide emulsion present in an adjacent layer. A process for the production of masked images by the silver dye bleach process such as has been described in German Auslegeschrift No. 2,547,720 is based on a similar effect, i.e. on the diffusion of iodide ions. According to this process, a material is used in which a layer containing developing nuclei is arranged between a first layer containing a dye which has the undesired secondary colour density which is to be corrected and a second dye. the main colour density of which corresponds to the secondary colour density of the first dye, an iodide-containing silver halide emulsion being allocated to the first dye but, on the other hand, a silver halide emulsion which is free from iodide or has a low iodide content being allocated to the second dye. A small amount of a silver halide solvent, for example thiosulfate, must be present when this material is developed. From the iodide-free emulsion assigned to the second dye, a soluble complex forms from the silver halide which has not been exposed and is not developable and this complex is reduced to metallic silver on the nuclei of the interlayer. If the silver halide emulsion assigned to the first dye has been exposed, iodide ions form at the image areas on subsequent developing and these ions likewise migrate into the layer of nuclei and prevent the deposition of silver from the complex at the particular areas. A silver image which is inverse to the silver image belonging to the first dye forms in the layer of nuclei. This is used in the subsequent bleaching process to bleach the second dye, as a result of which the desired masking effect is obtained. A further development of this process is described in German Offenlegungsschrift No. 2,831,814. In this case, a highly insensitive emulsion and, if desired, a stabiliser or development retarder are also added to the layer of nuclei, in order to intensify the masking effect. The reaction mechanism during formation of the mask image remains the same; however, the insensitive silver halide emulsion in the layer of nuclei acts as an additional silver donor, which likewise reacts to the iodide ions which migrate in.

The processes described in the two last-mentioned patent publications have proved very valuable for the production of masked images by the silver dye bleach process. However, they still have certain disadvantages which are related to the formation of soluble silver complexes in the developer solution containing thiosulfate. Thus, it is known that developer solutions which contain soluble silver complexes, as is unavoidable in the complex diffusion process, tend in time to deposit a sediment of silver. As a result of this, the vessels and the rollers used in developing machines and, ultimately, also the material itself are contaminated. It is true that it is possible to prevent the deposition of this sediment, at least for a certain time, by the addition of anti-sludge agents, for example certain mercaptans and organic disulfides, but this means that additional effort has to be expended, which increases the costs. Moreover, it has been found that the silver images which form in the presence of thiosulfate, even when the latter is only present in small amounts, are more difficult to bleach and therefore require the use of special bleaching accelerators.

The object of the present invention is to provide a novel process for the production of masked positive colour images by the silver dye bleach process, which novel process substantially overcomes the disadvantages which still exist.

It has been found that a masking effect can be achieved dispensing with silver complex diffusion, and the presence of the troublesome thiosulfate in the developer solution which this necessitates, if photographic materials for the silver dye bleach process are used which contain, in place of the layer of nuclei (German Offenlegungsschrift Nos. 2,547,720 and 2,831,814), a layer containing a pre-fogged silver halide emulsion which develops spontaneously to virtually the maximum density. The spontaneous development of such an emulsion, if the latter is itself free from iodide or has a low iodide content, can be influenced by migrating iodide ions in a manner similar to that known for the physical developing of silver complexes on nuclei. The speed at which the spontaneous development takes place can be matched to the rate of diffusion of the migrating iodide ions by means of a developing inhibitor present in the layer.

Pre-fogged emulsions for the production of masking or intermediate image effects by the utilisation of an image-wise diffusion of iodide ions from an adjacent layer are described, for example, in German Offenlegungsschrift No. 2,615,344. The effect in this case is, however, an effect which arises when soluble silver complexes are present:

During developing, silver nuclei form from the pre-fogged emulsion and silver is deposited on the nuclei as physical developing takes place. The iodide ions which migrate image-wise influence this physical developing and thus produce a mask image.

The present invention thus relates to a process for the production of masked positive colour images by the silver dye bleach process, by exposing a photographic material for the silver dye bleach process, silver developing, dye-bleaching, silver-bleaching and fixing, optionally, the step of silver-bleaching is carried out in a combined processing bath together with dye-bleaching and/or fixing, wherein the photographic material contains (a) in at least one layer, at least one first dye, which has at least one undesired secondary colour density which is to be compensated, (b) in the layer or layers (a) and/or in a layer adjacent to the said layer or layers (a), an iodide-containing silver halide emulsion allocated to the said dye or to each of the said dyes, (c) in at least one further layer, at least, in each case, a second dye, the main colour density of which corresponds to the secondary colour density of the first dye or dyes which is to be compensated, (d) in the layer or layers (c) and/or in a layer or layers adjacent to the said layer or layers (c), a silver halide emulsion which is free from iodide or has a low iodide content compared with the emulsions mentioned under (b) and is allocated to the said dye or dyes, and (e), in at least one layer (c) and/or in at least one further layer which is adjacent to the layer or layers (c) and which is separated from one or more layers (a) by at least one interlayer, a fogged silver halide emulsion which is free from iodide or has a low iodide content, is spontaneously developable to maximum density without exposure and contains a development retarder, and developing is carried out in a developer solution which does not contain any silver complexing agents.

According to another embodiment of the present invention a photographic material is provided which does not contain a fogged silver halide emulsion being free from iodide or has a low iodide content in the layer (c) but contains such an emulsion only in at least one layer which is adjacent to the layer or layers (c) and which is separated from one or more layers (a) by at least one interlayer.

The present invention also relates to the novel photographic silver dye bleach material for carrying out the process according to the invention, to the use of the material for the production of positive colour images and to the positive colour images produced.

A silver halide emulsion which is allocated to a dye layer is to be understood as meaning an emulsion which, after exposure and developing, provides a silver image which, in the subsequent dye bleach process, produces an inverse dye image in a known manner in the dye layer to which it is allocated. Usually, the emulsion is spectrally so sensitised that its sensitivity maximum coincides with the absorption maximum of the image dye to which it is allocated (is sensitive in the range of the complementary colour of the image dye). A trichromatic material which the entire visible colour spectrum can be reproduced can then be produced from three such dye/emulsion pairs in a known manner. It is, however, also possible for an emulsion allocated to a dye to be sensitised in a different spectral band, as is customary, for example, in the infra-red-sensitive false colour films.

Adjacent layers are to be understood as meaning those layers which because of their mutual position favour the exchange of chemical species-molecules or ions. The term therefore also includes those layers which are not immediately adjacent but may be separated from one another by one or more thin layers which do not prevent diffusion.

According to the present invention, the developing solution does not contain any complexing agent; the iodide ions which migrate in from the adjacent layer have a direct influence on the chemical developing of the pre-fogged emulsion.

Whilst, however, this chemical developing proceeds at a relatively high speed, a certain time elapses before the iodide ions which migrate in from the adjacent layer arrive at their site of action. These ions are, after all, only formed during the image-wise developing of the adjacent layer and in addition also have to cover the diffusion distance. It is therefore important that chemical developing does not start at least until the iodide ions which control the masking effect have arrived in the layer. This object is achieved by adding a development inhibitor to the layer which contains the pre-fogged emulsion.

Examples of suitable development inhibitors and retarders are benztriazole, 2-mercaptobenzthiazole, N-methylmercaptotriazole, 2-mercaptobenzoxazole, phenyl-mercaptotetrazole, triazolindolizine and their derivatives. Hints on the use of such development inhibitors are given, for example, in E. Birr, Mechanismus der Stabilisierung photographischer Emulsionen (Mechanism of the Stabilisation of Photographic Emulsions), Zeitschrift für wissenschaftliche Photographie No. 50,I,107 (1955). An important condition is that the solubility product of the silver salt formed from the development retarder is between that of silver chloride and that of silver iodide (cf. A. B. Cohen et al., in Photographic Sci. and Eng. 9, 96, (1965)).

In principle, all known development retarders which meet this condition are suitable. However, those compounds which can be incorporated as non-diffusing compounds in the photographic layers are preferentially suitable. Such compounds are in particular compounds which contain ballast groups nd are sparingly soluble or virtually insoluble in water. Suitable compounds of this type are, for example, 5-mercaptotetrazoles which in the 1-position are substituted by aryl groups, preferably polynuclear aryl, such as naphthyl or diphenyl, and can also be substituted by aryl groups substituted by preferably longer-alkyl ($C_3$–$C_{18}$), especially phenyl, and also by aralkyl or by alkyl having preferably not less than 3 and in particular 3 to 18 carbon atoms. Examples of development retarders which are particularly suitable are: 5-mercaptotetrazoles which are substituted in the 1-position by one of the following groups: n-propyl, i-propyl, n-butyl, i-butyl, t-butyl, i-amyl, i-octyl, t-octyl, nonyl, decyl, lauryl, myristyl, palmityl, stearyl, di-tert.-butyl-phenyl, octyl-phenyl, dodecylphenyl, naphthyl, $\alpha$- or $\beta$-naphthyl or diphenyl. Mercaptotetrazoles which do not have any actual ballast groups and are not fast to diffusion can also be used. However, in this case care must be taken that the development retarder does not diffuse in the undesired direction into an adjacent layer and, for example, retard developing of the emulsions which provide the iodide ions. This can be prevented, for example, by inserting an interlayer. Under this condition, it is also possible to use, for example, 5-mercaptotetrazoles substituted in the 1-position by the following groups: phenyl, phenyl substituted by hydroxyl, halogen (chlorine or bromine) or lower alkyl ($C_2$–$C_3$), benzoic acid methyl or ethyl ester, methyl or ethyl. In general, however, the use of non-diffusing development retarders is to be preferred because the layer build-up, in particular of those materials which have a multiplicity of dye layers and emulsion layers, can be considerably simplified by this means. The development retarders are used in amounts of 2 to 80 mmols and preferably of 20 to 40 mmols per mol of silver in the pre-fogged emulsion.

Pre-fogged silver halide emulsions which are spontaneously developable without exposure are produced by methods known per se, for example by incipient exposure or by chemical treatment with the conventional fogging agents, for example thiourea dioxide, tin-II chloride, hydrazine, boranes, formaldehyde-sulfoxylates or gold salts (complexes). Since the fogged emulsions must not develop too rapidly, silver bromide emulsions are preferably used. Smaller proportions of up to about 20 mol percent of silver chloride can be employed; emulsions with higher silver chloride contents in general are too rapidly developable. The proportion of silver iodide should be low and should not exceed about 1.0 mol percent, since otherwise the influence of migrating iodide ions on developing, which is used in the process according to the invention, would not be ensured.

The proceses which take place on exposure and subsequent processing will be explained below with the aid of the following test arrangement (see FIG. 1) with two image dyes: For this purpose, a material is used which has the following layers, in the given sequence from bottom to top, on a transparent base:

1. A gelatin layer containing a bleachable magenta coloured azo dye and a green-sensitised silver bromoiodide emulsion.
2. A gelatin interlayer.
3. A pre-fogged, spontaneously developable silver bromide layer which contains a development retarder.
4. A gelatin layer containing a bleachable yellow azo dye.

If a material of this type is now exposed behind a grey wedge and subsequently developed and further processed in the customary manner (dye-bleaching and silver-bleaching and fixing) using known treatment baths, the following processes take place: (FIG. 1):

(A) Unexposed Areas (maximum density of the copying wedge)

The pre-fogged emulsion develops spontaneously to maximum density; the green-sensitised emulsion remains unexposed and develops only to the fog level ($A_2$). The yellow layer allocated to the pre-fogged emulsion is consequently virtually completely bleached; the magenta layer remains unattacked ($A_3$).

(B) Exposure to Blue Light

Since the yellow dye layer is impervious to blue light, the green-sensitised emulsion layer allocated to the magenta layer is not exposed. The situation remains the same as under (A), i.e. the yellow layer is bleached to the maximum extent whilst the magenta layer remains completely intact ($B_3$).

(C) Exposure to Green or White Light

The green-sensitive emulsion is exposed step-wise, corresponding to the wedge. On developing ($C_2$), iodide ions form, proportional to the exposure which has taken place, and these migrate into the pre-fogged emulsion layer located above and there inhibit the spontaneous developing, which is independent of exposure. A silver image which opposes the image in the lower emulsion layer thus forms in this pre-fogged layer. After dye-bleaching and silver-bleaching, a dye image which is in the same sense as the original remains in the magenta layer and an inverse dye image remains in the yellow layer.

The experiment described above serves to demonstrate the mode of action of the arrangement. In practice, of course, the thickness and the silver halide concentration of the pre-fogged emulsion layer will be so adjusted that even in the maximum case, i.e. when the lower emulsion layer is completely unexposed, only that portion of the yellow layer which corresponds to the maximum secondary colour density in the blue of the unbleached magenta layer is bleached away.

Photographic silver dye-bleach materials used are in particular also those in which the optical density of at least one image dye layer, the main colour density of which corresponds to the secondary colour density which is to be compensated in another layer, is raised by an amount which compensates the density loss after processing when this other layer is not exposed, or in the state existing after exposure to blue light. It can easily be seen that a number of different masking effects can be achieved by the process described. Depending on the arrangement of the layers in the total assembly, it is possible to mask one or two secondary colour densities of one dye or to mask one secondary colour density of each of two dyes. The table (FIG. 2) shows the possible layer arrangements and combinations which result in the diverse masking effects.

The scheme of the layer arrangement shows only the general case, in which the dye and the associated emulsion sensitised in the colour complementary to the primary colour are present in the same layer. Of course, these co-related components can also be distributed between two or even three different layers adjacent to one another. Layer arrangements of this type have been described, for example, in German Offenlegungsschriften Nos. 2,036,918, 2,132,835 and 2,132,836. They are used in particular to influence the relatively steep gradation in silver dye-bleach materials or to increase the sensitivity.

Silver dye-bleach materials for the reproduction of coloured originals are in general trichromatic and contain three dye layers, one in each of the subtractive primary colours yellow, magenta and cyan. In order to achieve special effects, however, materials with other colours or with only two colour layers can also be used. Moreover, the image dyes which can be used are the yellow, magenta and cyan dyes known per se for this purpose, in combination with the appropriate spectral sensitisers.

Bleachable dyes which are suitable for the production of dye-containing silver halide emulsions for the silver dye-bleach material are described, for example, in U.S. Pat. Nos. 3,454,402, 3,443,953, 3,804,630, 3,716,368, 3,877,949, 3,623,874, 3,931,142 and 4,051,123.

The material can also additionally contain layers in which some of at least one of the two components image dyes and silver halide is lacking.

The light-sensitive silver halide emulsions used are usually those which contain silver chloride, silver bromide or silver iodide or mixtures of these halides. Iodide-containing silver halide emulsions usually contain between 0.1 and 10, preferably 1 to 5 mol percent of silver iodide; the remainder consists of silver chloride and/or silver bromide (for example 0 to 99.9 mol percent of silver chloride and 0 to 99.9 mol percent of silver bromide). Iodide-free silver halide emulsions preferably contain silver chloride, silver bromide or a silver chloride/silver bromide mixture.

Gelatin is customarily used as the protective colloid for the preparation of these emulsions; however, other water-soluble protective colloids, such as polyvinyl alcohol or polyvinylpyrrolidone and the like, can also be used; furthermore, some of the gelatin can be replaced by dispersions of high molecular weight substances which are not soluble in water. For example, it is customary to use dispersion polymers of $\alpha,\beta$-unsaturated compounds, such as acrylates, vinyl esters and vinyl ethers, vinyl chloride and vinylidene chloride and also of other mixtures and copolymers.

Interlayers (barrier layers) in general contain only pure binder, for example gelatin, and no dye or no silver halide. If it is advantageous for the total layer arrangement, however, an already existing emulsion layer or a filter layer can, if desired, also serve as the interlayer. In addition to gelatin, the interlayer can also contain further additives, such as the substances which inhibit dye-bleaching, additional binders, for example water-soluble colloids or water-insoluble dispersion polymers, and also the additives customary for forming the other photographic layers, such as softeners, wetting agents, light stabilisers, filter dyes or hardeners.

The emulsions can be applied to conventional layer bases for photographic recording material. Optionally, a mixture of several colloids can be used to disperse the silver halides.

The base can consist, for example, of unpigmented or pigmented cellulose triacetate or polyester. If it consists of paper fibres, these must be lacquer-coated or coated with polyethylene on both sides. The light-sensitive layers are located on at least one side of this base, preferably in the known arrangement, i.e. at the bottom and red-sensitised silver halide emulsion layer which contains a cyan azo dye, above this a green-sensitised silver halide emulsion layer which contains a magenta azo dye and at the top a blue-sensitive silver halide emulsion layer which contains a yellow azo dye. The material can also contain subbing layers, interlayers, filter layers and protective layers. The total thickness of the layers in the dry state should as a rule not exceed 20$\mu$.

Processing of the exposed silver dye-bleach materials is carried out in the conventional manner and comprises silver developing, dye-bleaching, silver-bleaching and fixing and subsequent washing and, if desired, also washing between the individual stages (cf., for example, German Offenlegungsschrift No. 2,448,443). Dye-bleaching and silver-bleaching, and if desired also fixing, can be combined in a single treatment stage.

Baths of conventional composition can be used for silver developing, for example those which contain hydroquinone as the developer substance and if desired additionally also contain 1-phenyl-3-pyrazolidinone, but no silver complexing agents. In addition, it can be advantageous if the silver developing bath also additionally contains a dye-bleach catalyst, as is described in Swiss Patent Specification No. 405,929.

If dye-bleaching is carried out as a separate treatment stage, the dye-bleaching baths used are advantageously those which contain a dye-bleach catalyst in addition to a strong acid, a water-soluble iodide and an antioxidant for the iodide. Combined dye-bleaching and silver-bleaching baths as a rule also contain a water-soluble oxidising agent, in addition to the indicated components. Suitable dye-bleach catalysts are in particular diazine compounds, for example derivatives of pyrazine, quinoxaline or phenazine. They are described, for example, In German Auslegeschriften Nos. 2,010,280, 2,144,298 and 2,144,297, in French Patent Specification No. 1,489,460, in U.S. Pat. No. 2,270,118 and in German Offenlegungsschrift No. 2,448,443.

In this context, strong acids are to be understood as meaning those which impart a pH value of not more than 2 to the dye-bleaching bath or to combined dye-bleaching and silver-bleaching baths. Acids which can be used are, for example, hydrochloric acid, phosphoric acid and in particular sulfuric acid or sulfamic acid.

The water-soluble iodide used can be an alkali metal iodide, for example potassium iodide or sodium iodide.

Suitable oxidising agents are nitroso compounds, for example p-nitrosodimethylaniline, nitro compounds, for example aromatic nitro compounds and preferably aromatic mono- or di-nitrobenzenesulfonic acids, for example m-nitrobenzenesulfonic acid.

The antioxidants used are advantageously reductones or water-soluble mercapto compounds. Suitable reductones are in particular aci-reductones with a 3-carbonylene-1,2-diol grouping, such as reductine, triosereductone or preferably ascorbic acid.

Suitable mercapto compounds are those of the formula $HSA(B)_m$, in which A is an aliphatic, cycloaliphatic, araliphatic, aromatic or heterocyclic bridge member, B is a radical conferring solubility in water and m is an integer of not more than 4 (German Offenlegungsschriften Nos. 2,258,076 and 2,423,819).

The silver mixing bath can be of known and conventional composition. A suitable fixing agent is, for example, sodium thiosulfate or advantageously ammonium thiosulfate, if desired with additives such as sodium bisulfite, sodium metabisulfite and/or ammonium bisulfite and also, if desired, complexing agents, such as ethylenediaminetetraacetic acid.

All of the treatment baths can contain further conventional additives, for example hardeners, wetting agents, fluorescent brighteners or UV stabilisers.

In the examples which follow parts and percentages are by weight, unless indicated otherwise.

EXAMPLE 1

The following layers are coated successively onto a transparent polyester base:

(a) An unsensitised silver iodobromide emulsion (94.1 mol percent of AgBr and 5.9 mol percent of AgI), which contains 55 g of silver and 71 g of gelatin per kg, and also, per kg, 3.16 g of the magenta dye of the formula

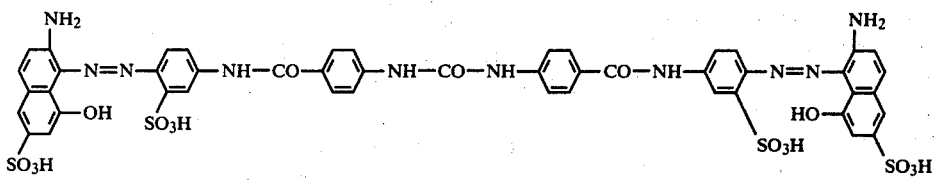

(101)

After drying, the layer thickness is about 2μ, which corresponds to a coating of 1.7 g of silver, 2.2 g of gelatin and 0.095 g of dye per $m^2$.

(b) A gelatin layer with a coating weight of 5.3 g per $m^2$.

(c) A pre-exposed (pre-fogged) silver bromide emulsion, which contains, per kg, 55 g of silver, 71 g of gelatin, 2 g of 1-phenyl-5-mercaptotetrazole (dissolved in 600 ml of ethylene glycol monoethyl ether) and 2.48 g of the yellow dye of the formula

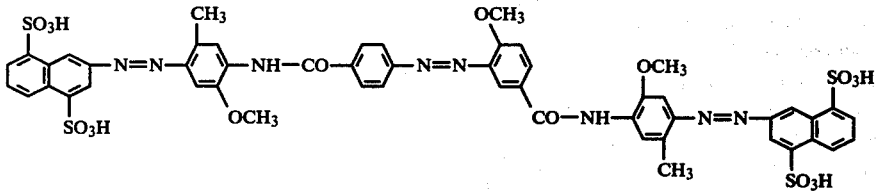

(102)

(dissolved in 248 ml of water). After drying, the layer thickness is 2μ, which corresponds to a coating of 1.7 g of silver, 2.2 g of gelatin and 0.075 g of dye per $m^2$.

A material is also prepared by coating the following layers successively onto a transparent polyester base:

(a) An unsensitised silver iodobromide emulsion (95 mol percent of AgBr and 5 mol percent of AgI), which contains 55 g of silver and 71 g of gelatin per kg, and also, per kg, 3.16 g of the magenta dye of the formula (101).

After drying, the layer thickness is about 2μ, which corresponds to a coating of 1.7 g of silver, 2.2 g of gelatin and 0.095 g of dye per $m^2$.

(b) A gelatin layer with a coating weight of 5.3 g per $m^2$.

(c) A pre-exposed (pre-fogged) silver bromide emulsion, which contains, per kg, 35 g of silver, 45.5 g of gelatin, 1.2 g of 1-phenyl-5-mercaptotetrazole (dissolved in 385 ml of ethylene glycol monoethyl ether) and 1.50 g of the yellow dye of the formula (102) (dissolved in 158 ml of water). After drying, the layer thickness is 2μ, which corresponds to a coating of 1.7 g of silver, 2.2 g of gelatin and 0.075 g of dye per $m^2$.

The samples of the coated and dried materials are exposed through a step wedge from the base side to white light and then processed as follows:

| | 3 minutes/20° C. |
|---|---|
| 1. Developing | |
| Hydroquinone | 6 g |
| 1-Phenyl-3-pyrazolidinone | 0.5 g |
| Potassium bromide | 2 g |
| Potassium hydroxide (85%) | 30 g |
| Potassium metabisulfite | 26 g |
| Boric acid | 16 g |
| $NH_4$ salt of ethylenetriaminetetraacetic acid | 2 g |
| Ascorbic acid | 10 g |
| Benztriazole | 0.5 g |
| Ethylene glycol monoethyl ether | 60.5 g |
| Water to make up to | 1 liter |

-continued

| | 3 minutes/20° C. |
|---|---|
| Combined dye-bleaching and silver-bleaching | |
| Sulfuric acid (96%) | 40 g |
| Na salt of 3-nitrobenzenesulfonic acid | 6 g |
| Potassium iodide | 8 g |
| 2,3,6-Trimethylquinoxaline | 2 g |
| Acetic acid (100%) | 2.1 g |
| 3-Mercaptobutyric acid | 1.75 g |
| Ethylene glycol monoethyl ether | 46.7 g |
| Water to make up to | 1 liter |
| 3. Fixing | |
| Ammonium thiosulfate (98%) | 200 g |
| Potassium metabisulfite | 25 g |
| Potassium hydroxide (85%) | 11 g |
| Water to make up to | 1 liter |

A wash is inserted between the individual processing steps and at the end.

On exposure, an latent silver image, inverse to the original, corresponding to the step wedge used, forms in the layer (a); in the layer (c) there is consistently a fully developable latent image, as a result of the pre-exposure of the emulsion. On developing the silver image in the layer (a), iodide ions are released proportionally to the intensity of the negative step image formed and these ions migrate through the interlayer (b) to the layer (c) and their inhibit developing of the latent image. An inverse silver image thus forms in this layer, i.e. the silver image in the layer (c) is weakest at the points where the deepest blackening occurs in the layer (a) and vice versa. The 1-phenyl-5-mercaptotetrazole, which acts as a development retarder, is prevented by the interlayer (b) from diffusing into the layer (a) and therefore has an influence only on the developing speed in the layer (c).

On subsequent combined dye-bleaching and silver-bleaching, a positive colour image inverse to the silver image forms in each of the layers (a) and (c).

The finished copy obtained after fixing and washing therefore has a positive magenta image in the same sense as the exposure wedge and an inverse yellow image.

EXAMPLE 2

According to Example 1 the following layers are coated successively onto a transparent polyester base:

(a) An unsensitised silver iodobromide emulsion (95.0 mol percent of AgBr and 5.0 mol percent of AgI), which contains 55 g of silver and 71 g of gelatin per kg, and also, per kg, 3.16 g of the magenta dye of the formula (101). After drying, the layer thickness is about 2μ, which corresponds to a coating of 1.7 g of silver, 2.2 g of gelatin and 0.095 g of dye per $m^2$.

(b) A gelatin layer with a coating weight of 5.3 g per $m^2$.

(c) A pre-exposed (pre-fogged) silver bromide emulsion, which contains, per kg, 35 g of silver, 45,5 g of gelatin, 2 g of 1-phenyl-5-mercaptotetrazole (dissolved in 385 ml of ethylene glycol monoethyl ether) and 1.59 g of the yellow dye of the formula (102) dissolved in 158 ml of water. After drying, the layer thickness is 2μ, which corresponds to a coating of 1,7 g of silver, 2.2 g of gelatin and 0,075 g of dye per $m^2$.

Samples of the coated and dryed materials are exposed through a step wedge from the base side to white light and then processed as shown in Example 1. On subsequent combined dye-bleaching and silver-bleaching, a positive colour image inverse to the silver image forms in each of the layers (a) and (c). In both materials the finished copy obtained after fixing and washing has a positive image in the same sense as the exposure wedge and an inverse yellow image.

EXAMPLE 3

The experiment described in Example 1 is repeated, except that in layer (c) a cyan dye of the formula

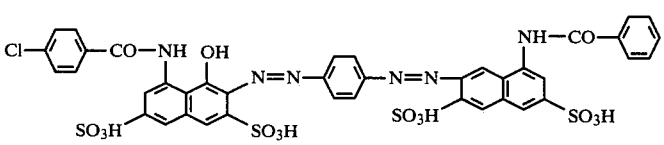

(103)

is used in place of the yellow dye.

After step exposure and subsequent processing, an image is obtained which has, in each case, a positive magenta image and an opposing negative cyan image.

EXAMPLE 4

In this experiment a material is used in which the yellow dye and the fogged emulsion assigned thereto are distributed completely separately between two adjacent layers, and the magenta layer and the iodide-containing emulsion assigned thereto are in part distributed between two adjacent layers. At the same time, a non-diffusing development retarder is used, so that the arrangement dispenses with the need for an interlayer between the two emulsion layers.

Four layers are applied to a transparent polyester base in the following sequence:

(a) Magenta dye layer with iodide-containing emulsion

The silver iodobromide emulsion used for layer (a) in Example 1 is green-sensitised in the conventional manner. 5.5 g of the magenta dye indicated in Example 1 are added, in the form of a 1% aqueous solution, to 100 g of this emulsion. After drying, the coating in this layer is 2 g of gelatin, 0.135 g of silver and 0.135 g of dye per $m^2$.

(b) Iodide-containing emulsion layer without dye

The green-sensitised emulsion used in the above layer (a) is coated, with the addition of further gelatin but without the addition of a dye, to give a layer of the following composition: gelatin 1.5 g, silver 0.315 g (dry weight).

(c) Fogged, iodide-free emulsion layer 10 g of 1-stearyl-5-mercaptotetrazole, dissolved in 1,500 ml of 0.02 normal aqueous sodium hydroxide solution, are added to 1 kg of a silver chloride/bromide emulsion (10 mol percent of silver chloride and 90 mol percent of silver bromide), which contains 71 g of silver and 73 g of gelatin per kg. The mixture is kept at 40° C. for 2 hours until all of the mercaptotetrazole has been adsorbed and is then pre-exposed, with stirring, to diffuse daylight. This fogged emulsion is used, with additional gelatin, to produce a layer which contains about 1.5 g of gelatin and 0.3 g of silver per $m^2$.

(d) 75 g of a 1% solution of the yellow dye used in layer (c) in Example 1 are added to 100 g of a 10% aqueous gelatin solution. A layer with a coating weight of 2 g of gelatin and 0.15 g of dye per $m^2$ is produced by coating with this mixture.

A sample of the dried, four-layer coating is exposed under a step wedge to green light. Processing of the exposed wedge is carried out in the same way as described in Example 1.

After processing has been carried out, a positive magenta-coloured step wedge superimposed with an inverse negative yellow wedge is obtained, similarly to Example 1.

Evaluation gives the following sensitometric values in analytical densities:

TABLE 1

| Exposure rel. log E | Green density λmax = 570 nm | Blue density λmax = 420 nm |
|---|---|---|
| 0 | 0.62 | 0.13 |
| 0.3 | 0.62 | 0.13 |
| 0.6 | 0.62 | 0.12 |
| 0.9 | 0.60 | 0.12 |
| 1.2 | 0.54 | 0.16 |
| 1.5 | 0.47 | 0.37 |
| 1.8 | 0.36 | 0.56 |
| 2.1 | 0.24 | 0.62 |
| 2.4 | 0.15 | 0.60 |

EXAMPLE 5

A material, suitable for the production of positive reflection copies, by the silver dye bleach process is prepared as follows: the following layers are applied successively to a white-opaque base: a red-sensitive layer pair consisting of ($a_1$) a red-sensitive gelatin/silver bromide/silver iodide emulsion layer which has a silver content of 0.149 g/$m^2$ and contains 0.145 g/$m^2$ of the bleachable cyan azo dye of the formula (103) and ($a_2$) a layer which is free from image dye and consists of a red-sensitive gelatin/silver bromide/silver iodide emulsion with a silver content of 0.300 g/$m^2$, (b) a gelatin interlayer with a coating weight of 4.08 g/$m^2$, a green-sensitive layer pair consisting of ($c_1$) a green-sensitive gelatin/silver bromide/silver iodide (95 mol percent of AgBr and 5 mol percent of AgI) layer which has a silver content of 0.138 g/$m^2$ and contains 0.174 g/m² of the bleachable magenta azo dye of the formula (101) and ($c_2$) a layer which is free from image dye and consists of a green-sensitive gelatin/silver bromide/silver iodide emulsion (95 mol percent of AgBr and 5 mol percent of AgI) with a silver content of 0.375 g/m², (d) a layer which is free from image dye and contains a spontaneously developable silver chloride/silver bromide emulsion (10 mol percent of AgCl and 90 mol percent of AgBr) which has a silver content of 0.400 g/m² and is inhibited with 1-stearyl-5-mercaptotetrazole (see Example 3c for the preparation of this emulsion), a blue-sensitive layer pair consisting of ($e_1$) a blue-sensitive, iodide-free gelatin/silver bromide layer which has a silver content of 0.400 g/m² and contains 0.149 g/m² of the yellow bleachable azo dye of the formula (102) and ($e_2$) a dye-free, blue-sensitive gelatin/silver bromide layer with a silver content of 0.360 g/m²; and (f) a gelatin protective layer.

The inter-image effect (compensation of the blue secondary colour density of the magenta layer) can be determined quantitatively in a simple way by exposing the green-sensitised layers through a step wedge: the optical density of the yellow layer in the blue spectral region in this case increases parallel to the exposure of the green-sensitive layers (and thus to the subsequent bleaching out of the magenta layer). The optimum inter-image effect is achieved when, for the fully exposed magenta layer, the increase in density of the yellow layer just corresponds to the blue secondary colour density of the magenta layer which has not been bleached out.

The material described above is exposed through a step wedge with a green colour filter and processed as follows:

| | |
|---|---|
| 1. Developing bath | 2½ minutes/20° C. |
| Composition as in Example 1 except that the benztriazole concentration is 1 g/l | |
| 2. Intermediate washing | 1 minute |
| 3. Combined dye-bleaching and silver-bleaching bath | |
| Composition as in Example 1 | 3 minutes/30° C. |
| 4. Intermediate washing | 1 minute |
| 5. Fixing bath | 3 minutes/20° C. |
| Composition as in Example 1 | |
| 6. Final washing | |

For comparison, a further material which is built up in the same way but in which the layer (d) does not contain any fogged emulsion is exposed through the same step wedge to green light and is then further treated in the same way as described above.

Table 2 below gives the resulting densities in the green spectral region (λ=570 nm) and in the blue spectral region (λ=420 nm) in each case for the various steps of the wedge (density of the original). Column (a) relates to the material according to Example 4 and column (b) to the comparison example without fogged emulsion in layer (d).

TABLE 2

| Optical density after exposure to green light (analytical density) | | | | |
|---|---|---|---|---|
| (a) material according to the invention with fogged emulsion | | (b) corresponding material without fogged emulsion | | |
| Density of original | Green density (magenta layer) $\lambda_{max.}$ = 570 nm | | Blue density (yellow layer) $\lambda_{max.}$ = 420 nm | |
| (step wedge) | (a) | (b) | (a) | (b) |
| 0 | 0.11 | 0.13 | 3.68 | 3.67 |
| 0.3 | 0.18 | 0.13 | 3.94 | 3.79 |
| 0.6 | 0.34 | 0.22 | 3.92 | 4.11 |
| 0.9 | 0.58 | 0.39 | 3.85 | 4.07 |
| 1.2 | 0.92 | 0.72 | 3.74 | 4.06 |
| 1.5 | 1.27 | 1.10 | 3.68 | 4.05 |
| 1.8 | 1.69 | 1.58 | 3.51 | 4.02 |
| 2.1 | 2.07 | 2.07 | 3.27 | 3.96 |
| 2.4 | 2.39 | 2.48 | 2.97 | 3.90 |

It can easily be seen from Table 2 that material (a) according to the present example displays the desired inter image effect, whilst material (b) does not show the effect.

If material (a) is exposed through a coloured transparency and then processed as described above, a positive copy of excellent colour reproduction is obtained. In respect of colour shade and saturation, not only the yellow hues but also the blue and red hues are equal to those of the original.

EXAMPLE 6

Strips of the material described in Example 4 are exposed and developed and each strip is then subjected to a bleaching treatment for 2 or 3 or 4 minutes in the bleaching bath described in Example 5. For comparison with the processing procedure according to U.S. Pat. No. 4,046,566, three samples of the same material is developed in accordance with the procedure described in U.S. Pat. No. 4,046,566, in a bath to which 1.4 g of crystalline sodium thiosulfate are added per liter.

In both cases the samples are fixed immediately after the bleaching treatment and the residual silver content in the fixed samples is determined.

| Bleaching time in minutes | Residual silver content mg/m² | |
|---|---|---|
| (30° C.) | (a) | (b) |
| 2 | 26 | 279 |
| 3 | 32 | 191 |
| 4 | 32 | 119 |

The table shows that with the process according to the invention, in which the addition of thiosulfate to the developer is dispensed with, the residual silver content in the fixed image can be considerably reduced, compared with that obtained when the process described in U.S. Pat. No. 4,046,566 is used.

The inter-image effect achieved remains virtually the same with both processes.

EXAMPLE 7

In this example the stability of a developer solution according to the invention is compared with that of a developer solution according to U.S. Pat. No. 4,046,566 which contains sodium thiosulfate in order to achieve the intermediate image effect.

Half of a sheet of the material described in Example 5 is exposed to white light and the sheet is then developed in a drum under the conditions indicated in Example 5.

The used developer is collected in a glass beaker and observed over a prolonged period. The solution remains clear and does not discolour even after standing for several days.

The experiment is then repeated under the same conditions except that 1.4 g of sodium thiosulfate ($Na_2S_2O_3.5\ H_2O$) per liter are added to the developer. On standing, the used developer has a brownish discoloration after only 10 minutes and is distinctly turbid after 20 minutes. After several hours, the walls of the glass beaker are coated with a brown deposit.

What is claimed is:

1. A process for the production of masked positive colour images by the silver dye bleach process, by exposing a photographic material for the silver dye bleach process, silver developing, dye-bleaching, silver-bleaching and fixing, optionally, the step of silver-bleaching is carried out in a combined treatment bath together with dye-bleaching and/or fixing, wherein the photographic material contains (a) in at least one layer, at least one first dye, which has at least one undesired secondary colour density which is to be compensated, (b) in the layer or layers (a) and/or in a layer adjacent to the said layer or layers (a), an iodide-containing silver halide emulsion allocated to the said dye or to each of the said dyes, (c) in at least one further layer, at least, in each case, a second dye, the main colour density of which corresponds to the secondary colour density of the first dye or dyes which is to be compensated, (d) in the layer or layers (c) and/or in a layer or layers adjacent to the said layer or layers (c), a silver halide emulsion which is free from iodide or has a low iodide content compared with the emulsions mentioned under (b) and is allocated to the said dye or dyes, and (e), in at least one layer (c) and/or in at least one further layer which is adjacent to the layer or layers (c) and which is separated from one or more layers (a) by at least one interlayer, a fogged silver halide emulsion which is free from iodide or has a low iodide content, is spontaneously developable to maximum density without exposure and contains a development retarder, and developing is carried out in a developer solution which does not contain any silver complexing agents.

2. A process according to claim 1, wherein the development retarder used is a 5-mercaptotetrazole substituted in the 1-position by an alkyl, aryl or aralkyl group.

3. A process according to claim 2, wherein the development retarder used is a 5-mercaptotetrazole substituted in the 1-position by alkyl having not less than 3 carbon atoms, aryl having not less than two nuclei or alkylaryl having not less than three carbon atoms in the alkyl moiety.

4. A process according to claim 1, wherein, in the photographic material, at least one interlayer which contains neither dye nor silver halide is arranged between the layer (e), which contains the pre-fogged silver halide emulsion, and the layer (b), which contains an iodide-containing silver halide emulsion.

5. A process according to claim 1, wherein the silver halide emulsions allocated to the image dyes have spectral sensitivities in the particular colour complementary to the image dye.

6. A process according to claim 1, wherein the silver halide emulsions allocated to the image dyes have spectral sensitivities other than those in the particular complementary colour.

7. A process according to claim 1, wherein the photographic material has additional layers in which at least one of the two components image dye and silver halide is lacking, at least in part.

8. A process according to claim 1, wherein a trichromatic material is used which contains, as the image dye, a cyan dye, a magenta dye and a yellow dye, each in individual layers.

9. A process according to claim 1, wherein the sensitised silver halide emulsions allocated to the individual image dyes are present in the same layer as the image dyes appertaining thereto.

10. A process according to claim 1, wherein the sensitised silver halide emulsions allocated to the individual image dyes are present, at least in part, in a layer adjacent to the dye layer.

11. A process according to claim 1, wherein a secondary colour density of an image dye in a multi-layer material is compensated.

12. A process according to claim 1, wherein two secondary colour densities of an image dye in a multi-layer material are compensated.

13. A process according to claim 1, wherein one secondary colour density of each of two image dyes in a multi-layer material is compensated.

14. A process according to claim 1, wherein the emulsion layers which are free from silver iodide and are allocated to a dye contain silver chloride or silver bromide or a mixture of the two halides.

15. A process according to claim 1, wherein the emulsions containing silver iodide contain 0 to 99.9 mol % of silver chloride, 0 to 99.9 mol % of silver bromide and 0.1 to 10 and preferably 1 to 5 mol % of silver iodide.

16. A process according to claim 1, wherein the pre-fogged, spontaneously developable emulsion is a silver chlorobromide or silver bromide emulsion which contains not more than 20 mol % of silver chloride and not more than 1.0 mol % of silver iodide and has been fogged by pre-exposure.

17. A process according to claim 1, wherein the pre-fogged, spontaneously developable emulsion is a silver chlorobromide or silver bromide emulsion which contains not more than 20 mol % of silver chloride and not more than 1.0 mol % of silver iodide and has been fogged by chemical treatment.

18. A photographic silver dye-bleach material for the production of masked positive colour images, which contains (a) in at least one layer, at least one first dye, which has at least one undesired secondary colour density which is to be compensated, (b) in the layer or layers (a) and/or in a layer adjacent to the said layer or layers (a), an iodide-containing silver halide emulsion allocated to the said dye or to each of the said dyes, (c) in at least one further layer, at least, in each case, a second dye, the main colour density of which corresponds to the secondary colour density of the first dye or dyes which is to be compensated, (d) in the layer or layers (c) and/or in a layer or layers adjacent to the said layer or layers (c), a silver halide emulsion which is free from iodide or has a low iodide content compared with the emulsion mentioned under (b) and is allocated to the said dye or dyes, and (e) in at least one layer (c) and/or in at least one further layer which is adjacent to the layer or layers (c) and which is separated from one or more layers (a) by at least one interlayer, a fogged silver halide emulsion which is free from iodide or has a low iodide content, is spontaneously developable to maximum density without exposure and contains a development retarder.

19. A silver dye-bleach material according to claim 18, wherein the optical density of at least one image dye layer, the main colour density of which corresponds to the secondary colour density to be compensated in another layer, is increased by an amount which compensates the loss in density after processing, when this other layer is not exposed.

* * * * *